US009580296B2

(12) United States Patent
Daniels et al.

(10) Patent No.: US 9,580,296 B2
(45) Date of Patent: Feb. 28, 2017

(54) VERTICAL STORAGE UNIT FOR DISPENSING A FUEL ADDITIVE

(71) Applicant: TITAN CHEMICAL TRANSFER SOLUTIONS, LLC, Greenville, SC (US)

(72) Inventors: Mark Daniels, Greenville, SC (US); Henrik Rokkjaer, Fernley, NV (US)

(73) Assignee: TITAN CHEMICAL TRANSFER SOLUTIONS, LLC, Greenville, SC (US)

( * ) Notice: Subject to any disclaimer, the term of this patent is extended or adjusted under 35 U.S.C. 154(b) by 0 days.

(21) Appl. No.: 14/943,529

(22) Filed: Nov. 17, 2015

(65) Prior Publication Data

US 2016/0115011 A1 Apr. 28, 2016

Related U.S. Application Data

(63) Continuation-in-part of application No. 14/304,558, filed on Jun. 13, 2014, now Pat. No. 9,216,890.

(51) Int. Cl.

| | |
|---|---|
| ***B67D 7/78*** | (2010.01) |
| ***B67D 7/02*** | (2010.01) |
| ***B67D 7/38*** | (2010.01) |
| ***B67D 7/62*** | (2010.01) |
| ***B67D 7/04*** | (2010.01) |
| ***F17D 3/01*** | (2006.01) |
| *B67D 7/36* | (2010.01) |
| *B67D 7/84* | (2010.01) |

(52) U.S. Cl.

CPC ..... *B67D 7/78* (2013.01); *B67D 7/02* (2013.01); *B67D 7/0288* (2013.01); *B67D 7/04* (2013.01);

(Continued)

(58) Field of Classification Search

CPC ..... B01F 15/00863; B65D 21/0235; B67D 3/0003; B67D 3/0093; B67D 7/02;

(Continued)

(56) References Cited

U.S. PATENT DOCUMENTS 4,339,307 A * 7/1982 Ellis, Jr. ..... B01D 1/0017 202/176
4,516,692 A * 5/1985 Croley ..... B65D 77/061 222/105

(Continued)

FOREIGN PATENT DOCUMENTS

DE EP 1862673 A2 * 12/2007 ..... F04D 13/021

*Primary Examiner* — Frederick C Nicolas
*Assistant Examiner* — Bob Zadeh
(74) *Attorney, Agent, or Firm* — McNair Law Firm, P.A.; Douglas W. Kim

(57) ABSTRACT

This invention is a vertical fluid storage system with an upper container connected to a lower container. A fill port can be used to fill the upper container wherein the top fill hose is in fluid communications with the upper container. A first top valve in line with the top fill hose can be included to or controlling the flow rate of fluid into the upper container from the fill port. A top fluid level sensor can be included in the upper container for sensing the fluid level of the upper container. A gravity port included in the upper container can allow fluid to flow from the upper container to the lower container either during filling or when fluid is removed from the lower container. A dispensing port can be included in the lower container for dispending fluid from the lower container through gravity of a pump.

20 Claims, 6 Drawing Sheets

(52) U.S. Cl.
CPC ..... *B67D 7/38* (2013.01); *B67D 7/62* (2013.01); *F17D 3/01* (2013.01); *B67D 7/36* (2013.01); *B67D 7/365* (2013.01); *B67D 7/84* (2013.01); *F01N 2610/02* (2013.01)

(58) Field of Classification Search
CPC ... B67D 7/36; B67D 7/38; B67D 7/62; B67D 7/78; B67D 7/0288; B67D 7/04; B67D 7/365; B67D 7/84; F17D 3/01
See application file for complete search history.

(56) References Cited

U.S. PATENT DOCUMENTS 5,029,602 A * 7/1991 McKinney ..... B67D 7/02 137/209
5,178,734 A * 1/1993 Palmer ..... B01D 3/02 159/44
5,259,509 A * 11/1993 Boal, Jr. ..... B65D 11/08 206/508
5,286,350 A * 2/1994 Huang ..... B01D 1/26 202/174
5,932,073 A * 8/1999 Land ..... B01D 3/42 159/DIG. 41
6,290,819 B1 * 9/2001 Land ..... B01D 3/42 202/181
9,216,890 B1 * 12/2015 Daniels ..... B67D 7/04
2001/0011655 A1 * 8/2001 Schutz ..... B65D 77/0466 220/9.4
2007/0135779 A1 * 6/2007 Lalomia ..... A61M 1/0005 604/319
2016/0115011 A1 * 4/2016 Daniels ..... B67D 7/78 222/56

* cited by examiner

VERTICAL STORAGE UNIT FOR DISPENSING A FUEL ADDITIVE

FIELD OF THE INVENTION

This invention is directed to a vertical storage and dispenser unit and more specifically to a vertical storage and dispensing unit for DEF.

BACKGROUND OF THE INVENTION

In the United States, the Clean Air Act established emission standards to regulate several pollutants that include nitrogen oxide (NOx), particulate matter (PM), carbon monoxide (CO), and hydrocarbons. One challenge for engine operators, under the Clean Air Act, is to limit the NOx emissions to comply with the ammonium g/bhp-hr standards. For operators of diesel engines, this standard proved to be problematic. One solution is known as the Selective Catalytic Reaction (SCR) technology.

SCR is an "after treatment" technology to reduce the NOx in the exhaust emissions of a diesel engine. The SCR relies upon an operating fluid called Diesel Exhaust Fluid or DEF. DEF is injected into the exhaust pipe in front of a SCR catalyst and downstream of the engine. The heat of the engine exhaust causes the DEF to decompose into ammonia. The NOx reacts with the ammonia in the catalyst and the NOx molecules are converted into $N_2$ and $H_2O$.

DEF is a solution that is about 32% of a high-priority area in deionized water the DEF is stored as a separate DEF tank, which is connected to the DEF injector. The average consumption of DEF is about 3% per gallon of diesel fuel so that the DEF tank is significantly smaller than the fuel tank.

Historically, operators would purchase DEF in small portable containers that would only hold a few gallons and use these portable containers to fill the DEF tanks associated with the diesel engine. Since about 3 gallons of DEF would be needed for about 100 gallons of fuel plastic containers from 35 to 15,000 gallons, over time, bulk containers began to appear and were located on-site of the operator so that the DEF tank was filled from a bulk dispenser.

However, storage of DEF began to exhibit problems due to the nature of DEF. For example, DEF freezes around 12° F. and will expand about 7%. As a result, the container expands and there is damage to the hose and pump. Additives should not be added to DEF to reduce the freezing point, as such additives can harm the SRC catalyst.

As DEF use increased, driven by the Clean Air Act, DEF dispensers were increasingly appearing at fuel islands so that DEF tanks could be refilled while filling diesel fuel tanks. However, given the limited space available at a fuel island, the tanks that would fit on the island had limited capacity. One solution was to stack containers or totes on top of one another so that the containers were arranged vertically to increase the storage capacity while maintaining the same footprint.

This arrangement was considered desirable given the vertical space between the ground and cover of a fuel island. The space could accommodate 18 wheel trucks. Unfortunately when the container on top needs to be filled, the fill opening has to be much higher than the operator can reach. As a result, a ladder is needed to fill the upper container. Having an operator stand on a ladder in a fuel island, while attempting to use a nozzle and hose to fill the upper container, is not desirable.

Another often overlooked disadvantage in the stacked configuration is that when a hose from the upper container is disconnected after filling or dispensing, the hose then becomes positioned lower than the upper container and fluid in the hose leaks out on to the ground or other undesirable location. Simply stacking two containers on top of one another is not the solution.

Another disadvantage with conventional storage containers is they are typically round to increase strength and prevent bulging. However, round containers typically do not properly fit on a fuel island and do not maximize the foot print for storage on a fuel island. Making a container with flat sides is advantageous for the fuel island, but the flat sides tend to bulge when a certain volume is reached so that the container extends over the fuel island. Attempts to strengthen the walls of a flat sided container lead to increased costs. Given the pressure of a full container, making one that is in excess of 10 feet in height results in a reinforced container that is not economical. It would be desirable to have a vertical shape system configured for a fuel island that could be filled completely from an operator at ground level.

Another difficulty created by the Clean Air Act is to have diesel engines that are used in remote areas to have DEF sources that are portable. For example, farm equipment, construction equipment, diesel engines, and the like. Many of these diesel engines operate in locations that are remote from fuel sources and therefore have high capacity fuel tanks. It would be advantageous to have a vertically stackable DEF source that can increase storage capability without increasing the footprint of the storage unit.

Additionally, portable DEF supplies also need to be refilled and it would be advantageous to be able to use the same hose, pump, and nozzle to fill the portable DEF source from a bulk container that is used to fill the DEF tank of a diesel engine from a DEF portable supply. It would also be advantageous to be able to refill the bulk container from a mobile DEF supply using the same pump configuration.

Therefore, it is an object of the present invention to provide for a vertical storage container that can be filled by an operator standing on the ground.

It is also an object of this invention to provide vertically stacked totes for storage of DEF.

It is also an object of the present invention to provide for a dispensing/fill assembly that can be used to fill the DEF source from a mobile storage container without duplicating the pump and hoses.

SUMMARY OF THE INVENTION

The objectives of the present invention are accomplished by providing a vertical fluid storage system comprising: a lower container for containing fluid; a lower fill port defined in the top of the lower container; a routing hose having a first section attached between the fill port and a swivel and a second portion attached between the swivel and a top fill hose; an upper container disposed above the lower container having a top fill port on the top of the upper container wherein the fill hose is connected; an upper outlet included in the upper container connected to a gravity hose wherein the gravity hose is connected to a gravity port; and, an intake valve attached to the lower container wherein the intake valve closes to prevent fluid from flowing from the upper container to the lower container when the amount of fluid in the lower container reaches a certain volume.

The intake valve can be a float valve in one embodiment. A dispensing port can be included in the lower container; a pump can be attached to the dispensing port by a first dispensing hose attached between the dispensing port and the pump; and, a nozzle can be attached to the pump by a second dispensing hose attached between the nozzle and the pump. The pump and first dispensing hose is removably attached to the lower container.

A spacer can be disposed between the lower and upper containers defining an access area.

The invention can include an upper container in fluid communications with the lower container; a fill port connected to a top fill hose to transfer fluid from the fill port to the upper container wherein the top fill hose is in fluid communications with the upper container; a top valve in line with the top fill hose for controlling the flow rate of fluid into the upper container; a top fluid level sensor carried by the upper container for sensing the fluid level of the upper container; a gravity port defined in the upper container and in fluid communications with a gravity hose attached to a lower container so that fluid can flow from the upper container to the lower container allowing the lower container to be filled from fluid in the upper container; and, a controller connected to the top valve and the top fluid level sensor so that when the top fluid level sensor determines that the upper container has a predetermined fluid level, the top valve is closed preventing overfilling of the upper container.

The invention can include a lower fluid level sensor connected to the controller; and, a lower valve in line with the gravity hose and connected to the controller so that when the lower fluid level sensor detects a predetermined fluid level of the lower container, the lower valve is closed and fluid entering the fill port is stored in the upper container.

The controller can include an electrical junction for receiving power from an external source and supplying power to the controller, top valve and top fluid level indicator. A dispensing port can be included in the lower container as well as a pump attached to the dispensing port by a second dispensing hose attached between the dispensing port and the pump. A nozzle can be attached to the pump by a first dispensing hose attached between the nozzle and the pump. The second dispensing hose can be removably attached to the lower container.

The invention can include a container cage containing a lower and upper container where the lower and upper container are vertically separated by a spacer; a fill port disposed in a space defined by the spacer; a top fill hose in fluid communications with the fill port and the upper container; a gravity hose connected between the upper container and the lower container; a lower fluid level sensor for determining the level of fluid in the lower container; and, a lower valve in line with the gravity hose so that the lower valve is closed when the lower fluid level sensor determines that there is a predetermined level of fluid in the lower container.

The controller can be attached to the lower fluid level sensor and the lower valve to prevent fluid from flowing from the upper container to the lower container when the amount of fluid in the lower container reaches a certain volume as detected by the lower level sensor. The invention can include a second upper container in fluid communications with the fill port so that fluid entering the fill port is transferred to the upper container and the second upper container. A second lower container can be in fluid communications with the second dispensing hose so that when fluid can be removed from the lower container and the second lower container by the pump. The gravity hose can be in fluid communications with the lower container and the second lower container. A second fluid level sensor can be attached to the second lower container and the controller; and, a second lower valve can be attached to the controller and in fluid communications with the second lower container.

The invention can also include a vertical fluid storage system having an first upper container in fluid communications with a first lower container; a second upper container in fluid communications with a second lower container; a fill port connected to a top fill hose to transfer fluid from the fill port to the first and second upper containers wherein the top fill hose is in fluid communications with the first and second upper containers; a first top valve in line with the top fill hose for controlling the flow rate of fluid into the first upper container and a second top valve in line with the top fill hose for controlling the flow rate of fluid into the second upper container; a first top fluid level sensor carried by the first upper container for sensing the fluid level of the first upper container and a second top fluid level sensor carried by the second upper container for sensing the fluid level of the second upper container; a first gravity port defined in the first upper container and in fluid communications with a first gravity hose attached to the first lower container so that fluid can flow from the first upper container to the first lower container allowing the first lower container to be filled from fluid in the first upper container; a second gravity port defined in the second upper container and in fluid communications with a second gravity hose attached to the second lower container so that fluid can flow from the second upper container to the second lower container allowing the second lower container to be filled from fluid in the second upper container; a controller connected to the first top valve, first top fluid level sensor, second top valve and second top fluid sensor so that when the first top fluid level sensor determines that the first upper container has a predetermined fluid level, the first top valve is closed preventing overfilling of the first upper container and when the second top fluid level sensor determines that the second upper container has a predetermined fluid level, the second top valve is closed preventing overfilling of the second upper container; a first dispensing port included in the first lower container; a second dispensing port included in the second lower container; a pump attached to the first and second dispensing ports a second dispensing hose attached between the dispensing ports and the pump; and, a nozzle attached to the pump by a first dispensing hose attached between the nozzle and the pump so that fluid can be pumped from the first and second lower containers.

The invention can include a first lower fluid level sensor connected to the controller a first lower valve in line with the first gravity hose and connected to the controller so that when the first lower fluid level sensor detects a predetermined fluid level of the first lower container, the first lower valve is closed and fluid entering the fill port is stored in the first upper container. The controller can include an electrical junction for receiving power from an external source and supplying power to the controller, top valve and top fluid level indicator.

The invention can include an upper container in fluid communications with a first lower container and a second lower container; a fill port connected to a top fill hose to transfer fluid from the fill port to the upper container wherein the top fill hose is in fluid communications with the upper container; a first top valve in line with the top fill hose for controlling the flow rate of fluid into the upper container; a top fluid level sensor carried by the upper container for sensing the fluid level of the upper container; a first gravity port defined in the upper container and in fluid communications with a first gravity hose attached to the first lower container and a second gravity hose attached to the second lower container so that fluid can flow from the upper container to the first and second lower containers allowing the first and second lower containers to be filled from fluid in the upper container; a controller connected to the top valve and top fluid level sensor so that when the top fluid level sensor determines that the upper container has a predetermined fluid level, the top valve is closed preventing overfilling of the upper container; a first dispensing port included in the first lower container; and, a second dispensing port included in the second lower container.

The invention can include an upper container in fluid communications with a lower container; a fill port connected to a top fill hose to transfer fluid from the fill port to the upper container wherein the top fill hose is in fluid communications with the upper container; a first top valve in line with the top fill hose for controlling the flow rate of fluid into the upper container; a top fluid level sensor carried by the upper container for sensing the fluid level of the upper container; a gravity port defined in the upper container and in fluid communications with a gravity hose attached to the lower container so that fluid can flow from the upper container to the lower container allowing the lower container to be filled from fluid in the upper container; a controller connected to the top valve and top fluid level sensor so that when the first top fluid level sensor determines that the upper container has a predetermined fluid level, the top valve is closed preventing overfilling of the upper container; and, a dispensing port included in the lower container for dispending fluid from the lower container.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

Figure 1:
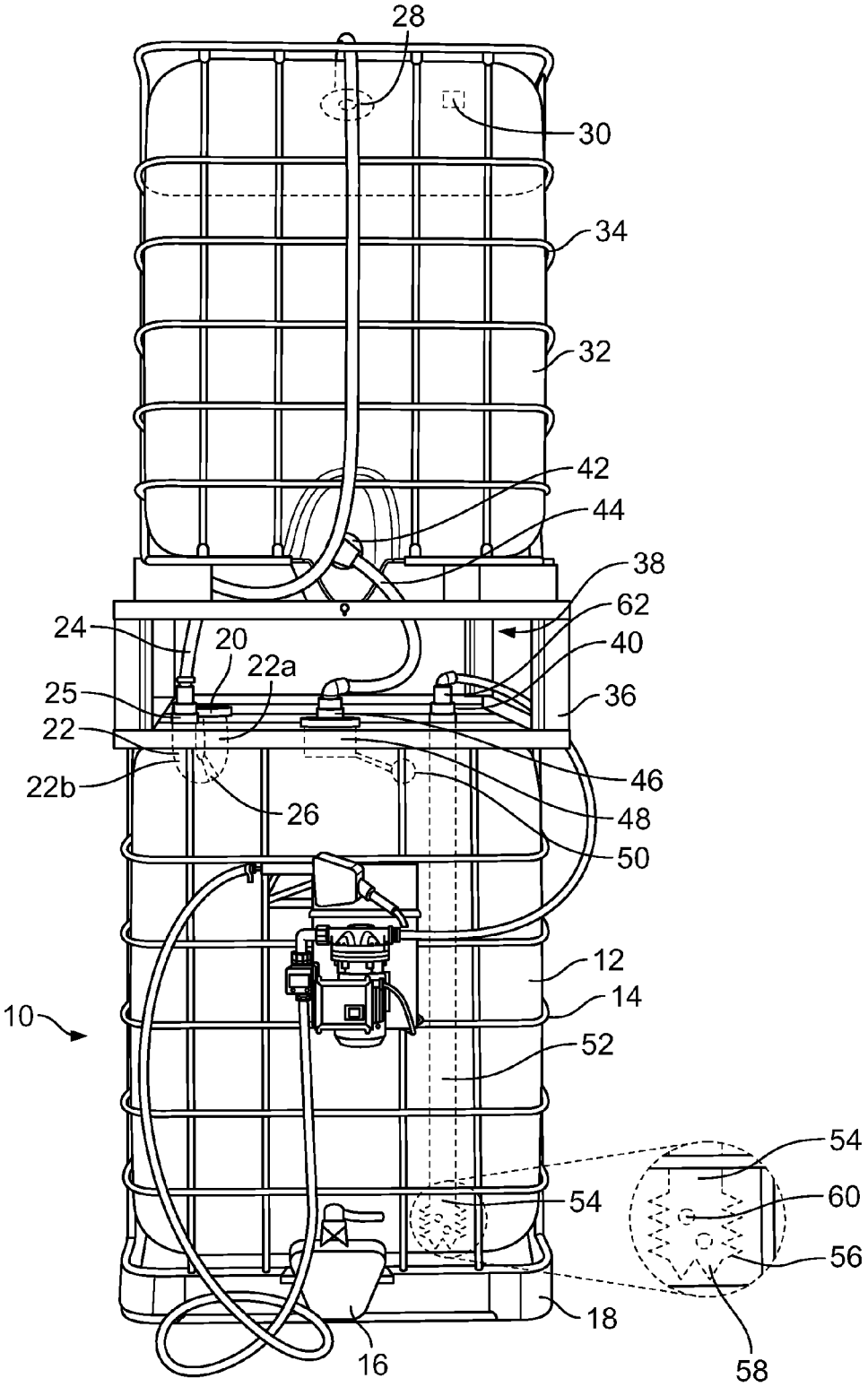
FIG. 1 is a perspective view of various components of the invention.

Referring to FIG. 1, a lower storage assembly 10 is shown having a lower container 12 and a lower cage 14 that receives the lower container. A lower drain assembly 16 is attached to the lower container. The lower drain assembly can include an outlet, valve and handle. A lower base 18 can be included with the lower storage assembly to support the lower storage assembly and to provide sufficient clearance for the lower drain assembly. A lower fill port 20 receives a nozzle or other apparatus to receive fluid from an external source such as another bulk container, mobile source or portable source. When fluid is received by the lower fill valve, the fluid is directed by a routing hose 22 to top fill hose 24. The top fill hose can be connected to a top fill hose port 25. The routing hose 22 includes a swivel 26 allowing the first section 22*a* of the routing hose to rotate about the second section 22*b* of the routing hose. When installing or otherwise manipulating the routing hose, the swivel allows the first section to be secured to the lower fill port by a threaded assembly so that when the first section is rotateably attached to the lower fill port, the hose does not kink or otherwise deform undesirably. Further, since the first section rotates independently of the second section, threading the first section on the lower fill port would not disconnect the second section from the top fill hose.

The top fill hose is attached to the top fill inlet 28 of the upper container 32. The top fill inlet can include a pressure relief assembly to prevent overfilling or over pressurizing. In one embodiment, a pressure relief valve 30 is included in the top of the upper container. When fluid is received by the lower fill valve, the fluid is under pressure so that the fluid is forced into the top fill hose and into the upper container. The fluid then is gravity fed into the upper outlet 42 and into the attached gravity hose 44 so that the fluid is delivered into the lower container through gravity port 46. The gravity port can include a fill valve or intake valve 48 that shuts off the gravity port once the lower container reaches a predetermined volume. In one embodiment, the fill valve is a float valve 50.

In operation, fluid is delivered to the lower fill port, travels through the routing hose into the top fill hose, fills the upper container, is gravity fed into the upper outlet and into the gravity hose and into the lower container. When the lower container is at a predetermined level, such as nearly full, the fill valve closes and the fluid can no longer flow through the gravity hose. Therefore, the upper container begins to fill. When the upper container is full, pressure in the routing hose increases which can be detected by a fill nozzle and the nozzle can automatically shut off. In one embodiment, the containers are transparent or semi-transparent allowing the operator to see the fluid level in the containers.

An upper cage 34 can be included to receive the upper container. The upper container and the lower container can be carried by a spacer 36 that is disposed between the two containers. The spacer defines an access area 38 allowing access to the lower fill valve, lower outlet 40 that can be connected to dispensing valve 62 and other components of the invention.

The lower outlet can include a snorkel 52 so that fluid can be removed from the lower container. The distal end 54 of the snorkel can include a resilient section 56 allowing the snorkel to contact the bottom of the container without permanent deformation. Extensions 58 can be included in the distal end so that if the distal end of the snorkel contacts the bottom of the container, fluid can still flow between the extensions. Opening 60 can be included in the distal end to allow fluid to flow into the snorkel even when the snorkel is contacting the bottom of the container.

Figure 2:
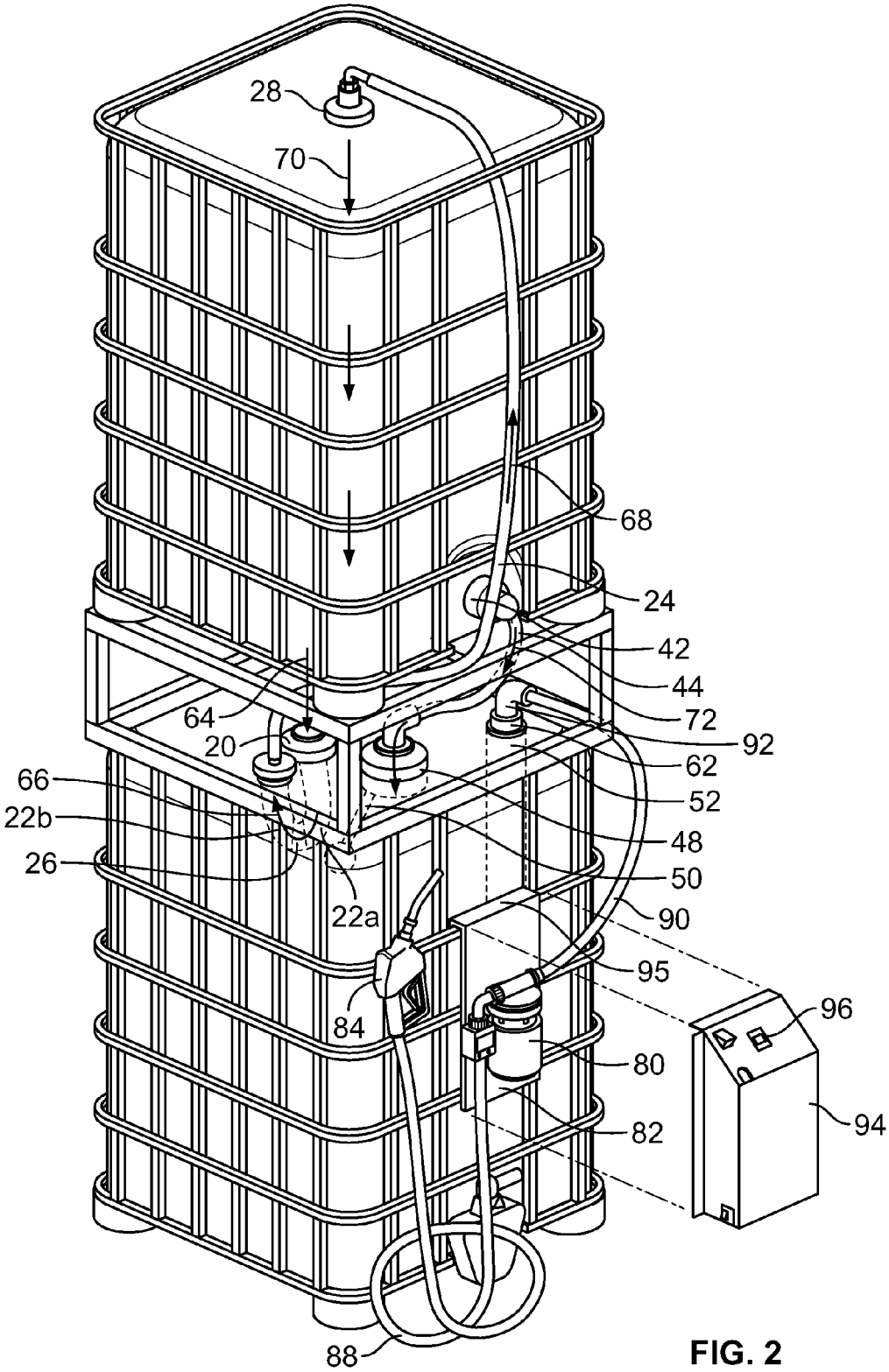
FIG. 2 is a perspective view of various components of the invention.

Referring to FIG. 2, the fluid enters the lower container at path 64 and travels through routing hose 22 along path 66. The fluid travels upward through the top fill hose along path 68 and into the top fill inlet. The fluid enters the upper container at 70 and drops to the bottom of the container. The fluid enters the upper outlet and travels through gravity hose 44 along path 72. The fluid then encounters the fill valve and if the fill valve is closed, the fluid will accumulate in the upper container. If the fill valve is open, the fluid will accumulate in the lower container.

In one embodiment, a pump 80 can be attached to a pump plate 82 so that the pump and pump plate are removably attached to the lower cage. Nozzle 84 is connected to the pump to dispense fluid from the container. A first dispensing hose 88 connects the nozzle to the pump. In one embodiment, the nozzle is a DEF nozzle. A second dispensing hose 90 is connected between the pump and a dispensing coupling 92. The pump can be powered by an external power source connected to the pump by the power cables and power cable clamps. In one embodiment, the pump can be contained within a pump housing that can be attached to the pump plate. The pump plate can include a pump bracket 95 that can be used to hang the pump plate on the lower cage. The pump housing 94 can include a nozzle carrier 96 for supporting the nozzle when the nozzle is not in use.

Figure 3A:
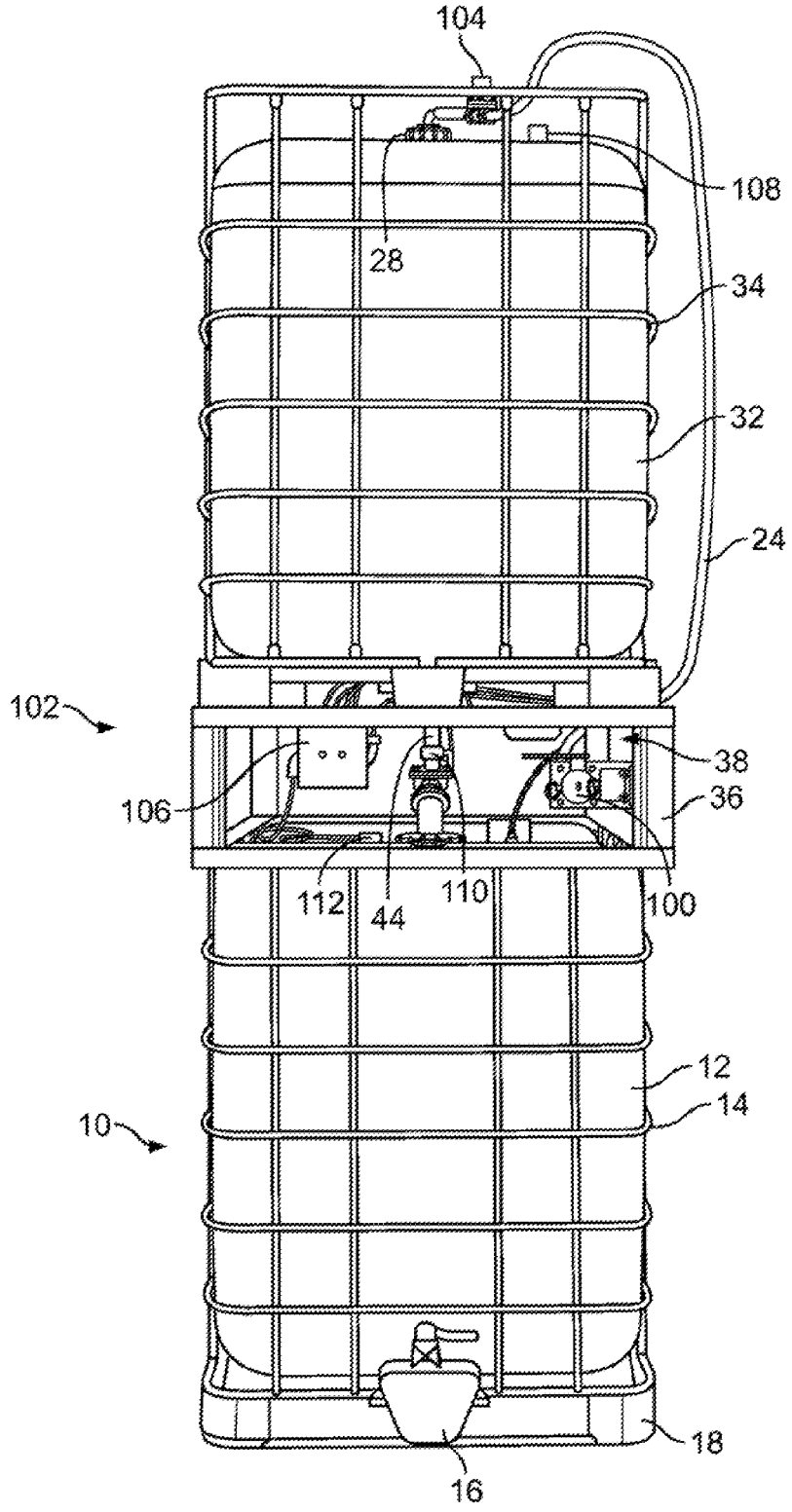
FIGS. 3A through 3C are front views of various components of the invention, and, FIG. 4 is a perspective view of various components of the invention.

Referring to FIG. 3A, the lower storage assembly includes a lower drain assembly 16 allowing fluid to be removed from the lower container 12. A lower cage 14 receives the lower container. Spacer 36 includes an access area 38 and is disposed between the lower container and upper cage 34 and upper container 32. In operation, fluid from an external source such as tank, truck tanker and the like, can be attached to a fill port 100. The external source is then in fluid communications with the fill port. The fill port can be attached to the spacer or otherwise carried by a frame 102. The fill port can be disposed generally below the upper container and generally above the lower container for ease of access. The frame can include the spacer, upper cage, lower cage or any combination thereof. When fluid enters the fill port, it travels in the top fill hose 24 and is directed from the fill port to the upper container. The top fill hose is connected to a top fill outlet 28 allowing fluid from the fill port to enter the upper container. A top valve 104 can be in line with the top fill hose and can control the flow of liquid into the upper container. The top valve can be in electronic communications with controller 106 that can both receive information from the top valve, transmit information to the top valve, and power the top valve. The controller can control the flow rate of fluid into the upper container by actuating the top valve so that only a certain flow rate is accomplished. A top fluid level sensor 108 can determine the fluid level of the upper container and transmit the information to the controller. The controller can have computer readable instructions that can determine when the top fluid level sensor detects a fluid level of the upper container and can close the top valve to prevent overfilling of the upper container. When the top fluid level sensor detects that the fluid is at a predetermined level, the top valve can be closed.

Figure 3B:
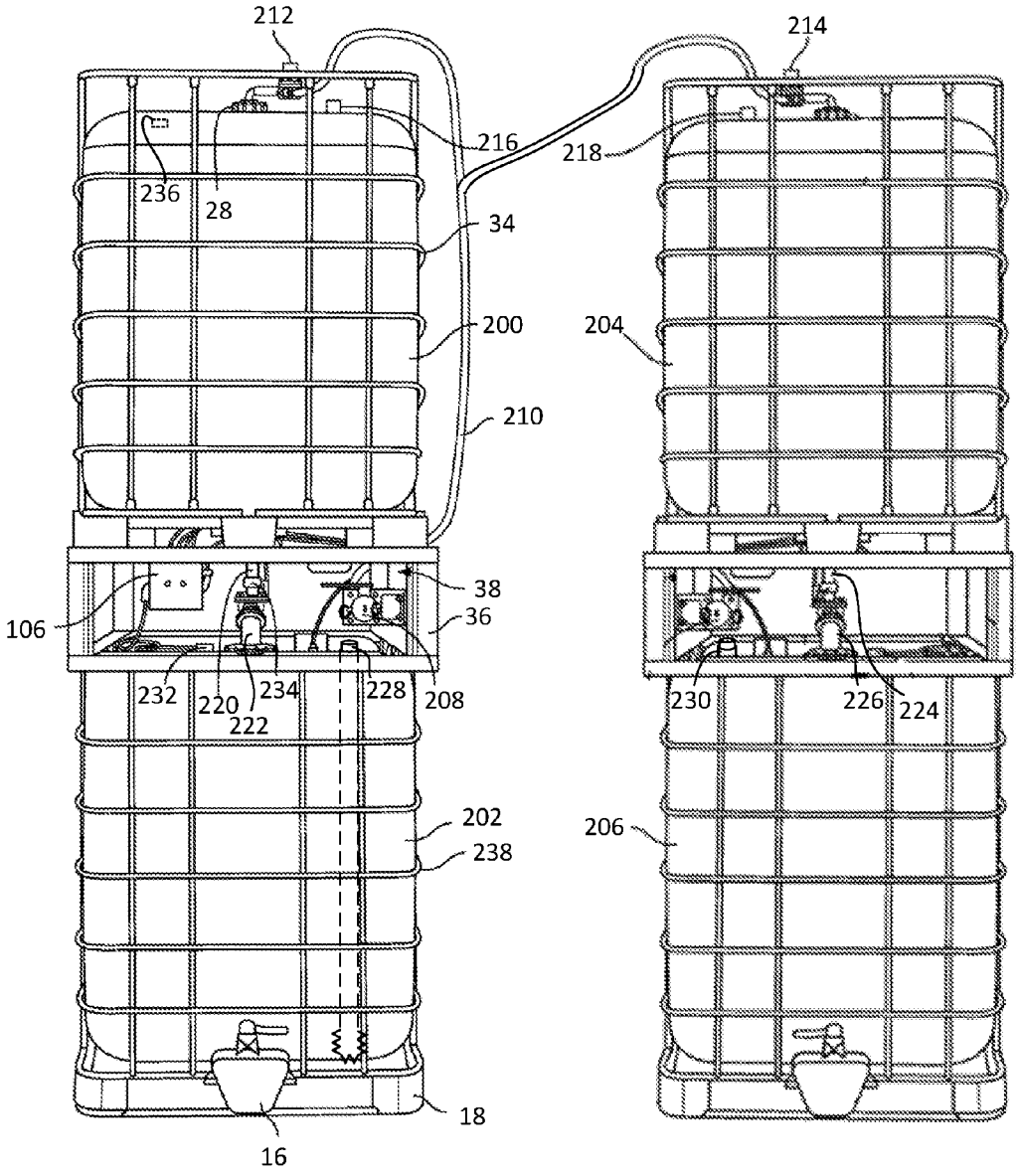
Figure 3C:
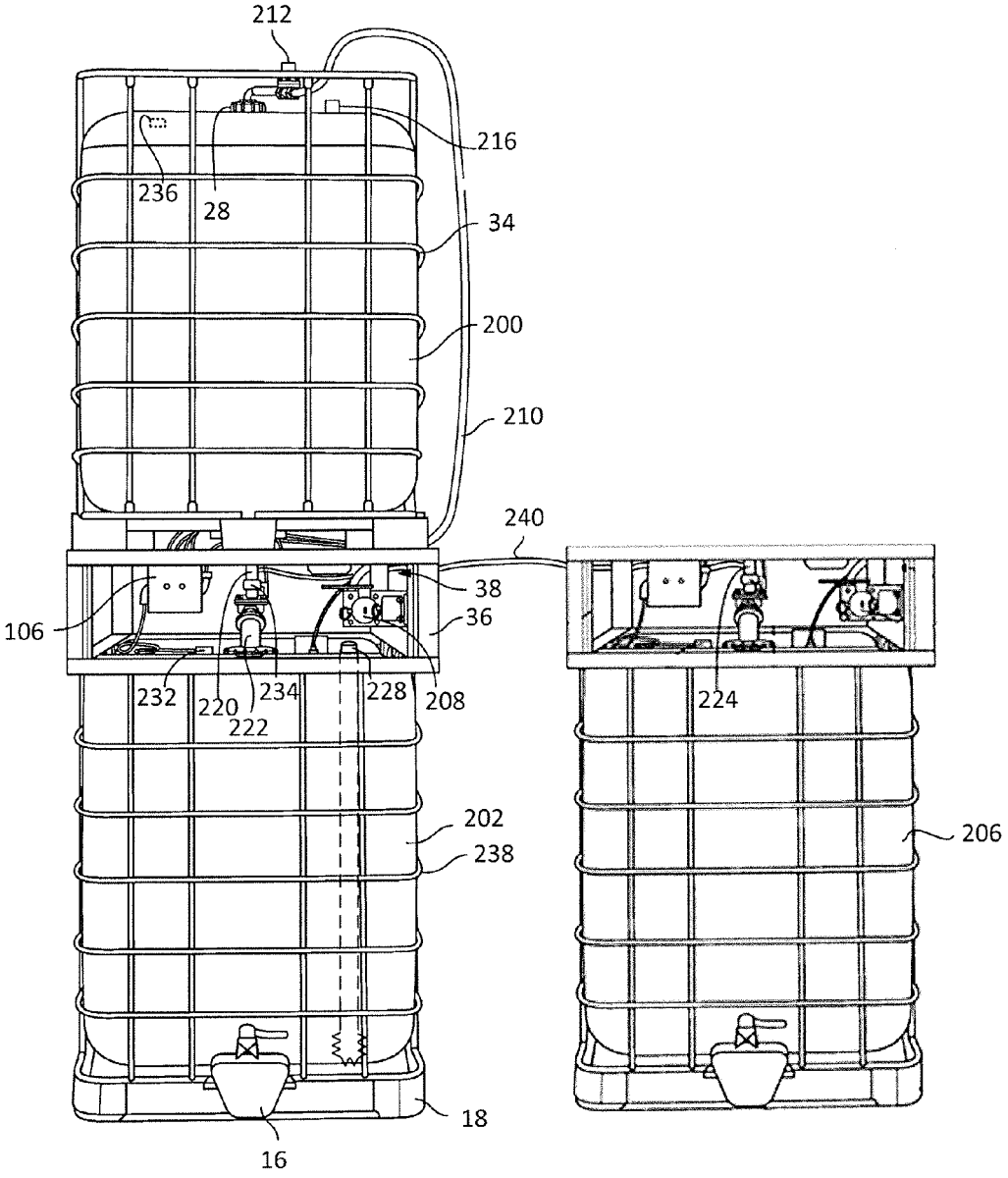

Referring to FIG. 3B, a first upper container 200 can be in connection with a first lower container 202 to allow DEF fluid to flow from the first upper container to the first lower container. A second upper container 204 can be in connection with a second lower container 206 to allow DEF fluid to flow from the second upper container to the second lower container. A fill port 208 can be connected to a top fill hose 210. When fluid enters the fill port, it travels in the top fill hose 210 and is directed from the fill port to the first and second upper containers. A first top valve 212 can be in line with the top fill hose for controlling a first flow rate of DEF fluid into the first upper container and a second top valve 214 in line with the top fill hose for controlling a second flow rate of DEF fluid into the second upper container. A first top fluid level sensor 216 can determine the fluid level of the first upper container and transmit the information to the controller. A second top fluid level sensor 218 can determine the fluid level of the second upper container and transmit the information to the controller. A first gravity port 220 can be defined in the first upper container and connected to a first gravity hose 222 attached to the first lower container so that DEF fluid can flow from the first upper container to the first lower container allowing the first lower container to be filled with DEF fluid from the first upper container. A second gravity port 224 can be defined in the second upper container and connected to a second gravity hose 226 attached to the second lower container so that DEF fluid can flow from the second upper container to the second lower container allowing the second lower container to be filled with DEF fluid from the second upper container. A first dispensing port 228 can be included in the first lower container and a second dispensing port 230 can be included in the second lower container. A first lower fluid level sensor 232 attached to the first lower container can be connected to the controller. A first lower valve 234 can be in line with the first gravity hose and connected to the controller so that when the first lower fluid level sensor detects a predetermined DEF fluid level of the first lower container, the first lower valve is closed and DEF fluid entering the fill port is stored in the first upper container. A first pressure relief valve 236 can be included in the first upper container. A first lower cage 238 can contain the first lower container. In one embodiment, shown in FIG. 3C, one of the upper containers can be connected by hoses 222 and 240 to the first lower container 202 and the second lower container 206 allowing DEF fluid to flow into the lower containers.

The upper container can include a gravity port connected to a gravity hose 44 allowing fluid to flow from the upper container into the lower container. A lower valve 110 can be in line with the gravity hose and determine the flow rate of fluid from the upper container into the lower container. A lower fluid level sensor 112 can determine if the fluid level of the lower container reaches a certain level and close the lower valve to prevent overfilling of the lower container. When the lower fluid level sensor determines that the fluid level of the lower container is at a predetermined level, the lower valve can be closed. The predetermined levels of fluid can be determined based upon expansion due to temperature to prevent over pressure, maximum volume of containers, clearance level for the various components attached to container and the like. When the lower container valve is closed, fluid entering the fill port that is transferred to the upper container fills the upper container. The flow rate of the lower valve can be larger than the flow rate of the top valve to assist in preventing the overfilling of the upper container. When fluid is removed from the lower container, the lower fluid level sensor can transmit the fluid level to the controller and the lower valve can be actuated by the controller to allow fluid to flow from the upper container to the lower container. In one embodiment, the lower valve can remain open so that when fluid is pumped out of the lower container, the fluid in the upper container is transferred to the lower container.

Figure 4:
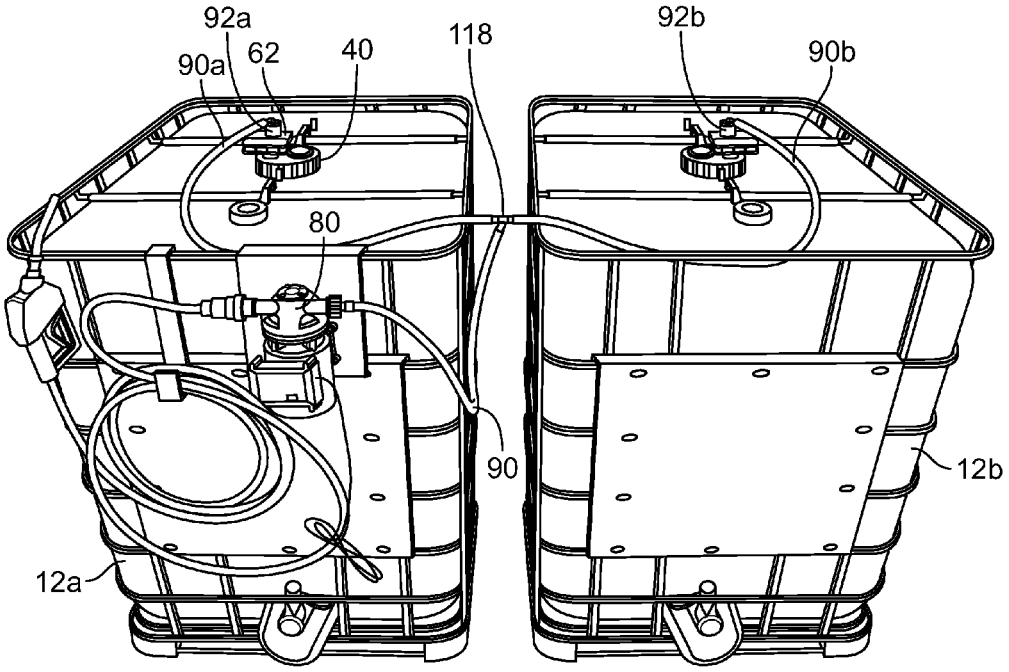

Referring to FIG. 4, the lower containers are shown with their upper containers removed. One or more lower containers can include an upper container. In this embodiment, a first assembly of a lower container and upper container can be connected to a second assembly of the lower container and an upper container to form multiple vertical storage assemblies. The lower container can include a lower hose connector 118 that connects the second dispensing hose 90 attached to the pump 80 to a first dispensing routing hose 90*a* to a second dispensing routing hose 90b so that fluid is drawn from the first lower container 12*a* and the second lower container 12*b* without the need for two pumps. The first dispensing coupling 92*a* is connected to the first dispensing routing hose and the second dispensing coupling 92*b* is connected to the second routing dispensing hose. For the upper containers, an upper hose connecter can be used to split and connect the top fill hose to two or more upper containers so that when the fill port receives fluid, it is transferred to two or more upper containers.

The controller can include relays that are connected to the top valve, top fluid level indicator, lower valve and lower fluid level indicator. An external power connector can be used to provide power to the controller at power junction which can in turn power the pump, top valve, top fluid level indicator, lower valve and lower fluid level indicator.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to," or other like phrases in some instances shall not be read to mean that the narrower case is intended or required in instances where such broadening phrases may be absent.

What is claimed is:

1. A vertical fluid storage system comprising:

a first upper container connected to a first lower container and configured to allow DEF to flow from the first upper container to the first lower container;

a second upper container connected to a second lower container and configured to allow DEF to flow from the second upper container to the second lower container;

a fill port connected to a top fill hose to transfer DEF from the fill port to the first upper container and the second upper container wherein the top fill hose is connected to the first upper container and the second upper container;

a first top valve in line with the top fill hose for controlling a first flow rate of DEF into the first upper container and a second top valve in line with the top fill hose for controlling a second flow rate of DEF into the second upper container;

a first top fluid level sensor carried by the first upper container for sensing the DEF level of the first upper container and a second top fluid level sensor carried by the second upper container for sensing the DEF level of the second upper container;

a first gravity port defined in the first upper container connected to a first gravity hose attached to the first lower container so that DEF can flow from the first upper container to the first lower container allowing the first lower container to be filled from DEF in the first upper container;

a second gravity port defined in the second upper container connected to a second gravity hose attached to the second lower container so that DEF can flow from the second upper container to the second lower container allowing the second lower container to be filled from DEF in the second upper container;

a controller connected to the first top valve, first top fluid level sensor, second top valve and second top fluid sensor so that when the first top fluid level sensor determines that the first upper container has a predetermined fluid level, the first top valve is closed preventing overfilling of the first upper container and when the second top fluid level sensor determines that the second upper container has a predetermined fluid level, the second top valve is closed preventing overfilling of the second upper container;

a first dispensing port included in the first lower container;

a second dispensing port included in the second lower container;

a pump attached to the first dispensing port and the second dispensing port and a dispensing hose attached between the first dispensing port and second dispensing port and the pump; and, a nozzle attached to the pump by a first dispensing hose attached between the nozzle and the pump so that fluid can be pumped from the first and second lower containers.

2. The system of claim 1 including:

a first lower fluid level sensor connected to the controller; and, a first lower valve in line with the first gravity hose and connected to the controller so that when the first lower fluid level sensor detects a predetermined DEF level of the first lower container, the first lower valve is closed and DEF entering the fill port is stored in the first upper container.

3. The system of claim 1 wherein the controller includes an electrical junction for receiving power from an external source and supplying power to the controller, the first top valve, the second top valve, and top fluid level indicator.

4. The system of claim 1 including a snorkel connected to the first dispensing port and contained within the first lower container so that DEF can be removed from the first lower container.

5. The system of claim 1 including a first pressure relief valve included in the first upper container.

6. The system of claim 1 including a first lower cage for containing the first lower container.

7. The system of claim 6 wherein a pump is removabley carried by the first lower cage.

8. A vertical fluid storage system comprising:

an upper container connected to a first lower container and a second lower container;

a fill port connected to a top fill hose to transfer DEF from the fill port to the upper container wherein the top fill hose is connected to the upper container;

a first top valve in line with the top fill hose for controlling a flow rate of DEF into the upper container;

a top fluid level sensor carried by the upper container for sensing the DEF level of the upper container;

a first gravity port defined in the upper container connected to a first gravity hose attached to the first lower container and a second gravity hose attached to the second lower container so that DEF can flow from the upper container to the first lower container and the second lower container allowing the first lower container and the second lower container to be filled from DEF in the upper container;

a controller connected to the first top valve, second top valve and top fluid level sensor so that when the first top fluid level sensor determines that the first upper container has a predetermined DEF level, the first top valve is closed preventing overfilling of the first upper container;

a first dispensing port included in the first lower container; and, a second dispensing port included in the second lower container.

9. The system of claim 8 including:

a pump connected to the first dispensing port and the second dispensing port; and, a nozzle attached to the pump so that DEF can be pumped out of the first and second lower containers.

10. The system of claim 8 including:

a first lower fluid level sensor for detecting DEF levels of the first lower container and connected to the controller;

a second lower fluid level sensor for detecting DEF levels of the second lower container and connected to the controller;

a first lower valve in line with the first gravity hose and connected to the controller so that when the first lower fluid level sensor detects a predetermined DEF level of the first lower container, the first lower valve is closed and DEF entering the fill port is stored in the upper container; and, a second lower valve in line with the second gravity hose and connected to the controller so that when the second lower fluid level sensor detects a predetermined DEF level of the second lower container, the second lower valve is closed and DEF entering the fill port is stored in the upper container.

11. The system of claim 8 including a pressure relief valve included in the upper container.

12. The system of claim 8 wherein the controller includes an electrical junction for receiving power from an external source and supplying power to the controller, the first top valve and top fluid level indicator.

13. The system of claim 8 including a spacer disposed between the upper container and the first lower container defining an access area for receiving the controller.

14. The system of claim 8 including a first lower cage for containing the first lower container.

15. The system of claim 14 including:

a pump connected to the first dispensing port and the second dispensing port and removably mounted on the first lower cage; and, a nozzle attached to the pump so that DEF can be pumped out of the first lower container and second lower container.

16. A vertical fluid storage system comprising:

an upper container connected to a lower container configured to allow DEF to flow from the upper container to the lower container;

a fill port connected to a top fill hose to transfer DEF from the fill port to the upper container wherein the top fill hose is connected to the upper container;

a first top valve in line with the top fill hose for controlling a flow rate of DEF into the upper container;

a top fluid level sensor carried by the upper container for sensing the DEF level of the upper container;

a gravity port defined in the upper container and connected to a gravity hose attached to the lower container so that DEF can flow from the upper container to the lower container allowing the lower container to be filled with DEF in the upper container;

a controller connected to the first top valve and top fluid level sensor so that when the first top fluid level sensor determines that the upper container has a predetermined DEF level, the first top valve is closed preventing overfilling of the upper container; and, a dispensing port included in the lower container for dispending DEF from the lower container.

17. The system of claim 16 including a lower fluid level sensor for detecting DEF levels of the lower container and connected to the controller.

18. The system of claim 17 including a lower valve in line with the gravity hose and connected to the controller so that when the lower fluid level sensor detects a predetermined DEF level of the lower container, the lower valve is closed and DEF entering the fill port is stored in the upper container.

19. The system of claim 16 including:

a pump connected to the dispensing port disposed on top of the lower container for dispending DEF from the lower container;

a snorkel connected to the dispensing port so that DEF can be removed from the lower container; and, a nozzle attached to the pump so that DEF can be pumped out of the lower container.

20. The system of 16 wherein the controller includes an electrical junction for receiving power from an external source and supplying power to the controller, first top valve, top fluid level sensor, and a pump.

* * * * *